US009175502B2

(12) United States Patent
Zuraski et al.

(10) Patent No.: US 9,175,502 B2
(45) Date of Patent: Nov. 3, 2015

(54) RESETTABLE COMBINATION LOCK MECHANISM

(71) Applicant: Schlage Lock Company LLC, Indianapolis, IN (US)

(72) Inventors: Robert David Zuraski, Taunton, MA (US); Son Minh Luong, Haverhill, MA (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 13/964,025

(22) Filed: Aug. 9, 2013

(65) Prior Publication Data

US 2014/0041424 A1 Feb. 13, 2014

Related U.S. Application Data

(60) Provisional application No. 61/681,536, filed on Aug. 9, 2012.

(51) Int. Cl.
*E05B 37/02* (2006.01)
*E05B 37/00* (2006.01)

(52) U.S. Cl.
CPC ..... *E05B 37/0048* (2013.01); *E05B 37/0058* (2013.01); *E05B 37/025* (2013.01); *Y10T 70/7305* (2015.04); *Y10T 70/7322* (2015.04); *Y10T 70/8027* (2015.04)

(58) Field of Classification Search
CPC ..... E05B 37/0048; E05B 37/0058; E05B 37/025; E05B 37/02; E05B 37/04; E05B 37/08; E05B 37/10; E05B 41/00; Y10T 70/7322; Y10T 70/7305; Y10T 70/8027
USPC ..... 70/312, 432
See application file for complete search history.

(56) References Cited

U.S. PATENT DOCUMENTS

| | | | | | |
|---|---|---|---|---|---|
| 4,341,101 | A | * | 7/1982 | Bako | 70/312 |
| 4,343,164 | A | * | 8/1982 | Bako | 70/312 |
| 4,354,366 | A | * | 10/1982 | Bako | 70/312 |
| 4,355,524 | A | * | 10/1982 | Bako | 70/312 |
| 4,389,863 | A | * | 6/1983 | Bako | 70/312 |
| 4,520,641 | A | * | 6/1985 | Bako | 70/312 |
| 5,027,623 | A | * | 7/1991 | Ling | 70/26 |
| 5,636,539 | A | | 6/1997 | Tsai | |
| 5,934,120 | A | | 8/1999 | Kuo | |
| 6,209,368 | B1 | | 4/2001 | Lee | |
| 6,386,005 | B1 | * | 5/2002 | Kuo | 70/28 |
| 6,422,051 | B1 | | 7/2002 | Kuo | |
| 6,439,006 | B1 | | 8/2002 | Tsai | |
| 6,508,089 | B1 | * | 1/2003 | Tsai | 70/213 |
| 6,598,434 | B2 | * | 7/2003 | Yang | 70/213 |
| 6,711,922 | B1 | | 3/2004 | Tsai | |
| 6,799,445 | B1 | | 10/2004 | Tsai | |

(Continued)

OTHER PUBLICATIONS

International Search Report and Written Opinion, PCT/US13/54432, dated Jan. 16, 2014.

*Primary Examiner* — Lloyd Gall
(74) *Attorney, Agent, or Firm* — Taft Stettinius & Hollister LLP

(57) ABSTRACT

A resettable lock assembly is provided having features that indicate when the lock is in reset mode or normal-use mode. The lock assembly may include a reset knob operable in a first rotational position and a second rotational position. When the reset knob is in the first rotational position, the lock assembly is in a reset mode and a visual indicator is visible.

1 Claim, 6 Drawing Sheets

(56) References Cited

U.S. PATENT DOCUMENTS

| | | | | |
|---|---|---|---|---|
| 6,799,446 | B1 | 10/2004 | Tsai | |
| 6,845,643 | B2 | 1/2005 | Tsai | |
| 7,131,299 | B1 * | 11/2006 | Huang | 70/21 |
| 7,216,517 | B2 * | 5/2007 | Ling et al. | 70/21 |
| D545,174 | S | 6/2007 | Sloan | |
| 7,254,971 | B2 | 8/2007 | Ruan | |
| 7,337,637 | B2 | 3/2008 | Kan | |
| 7,357,007 | B2 * | 4/2008 | Lin | 70/21 |
| 7,370,497 | B2 * | 5/2008 | Yu | 70/21 |
| 7,415,853 | B2 * | 8/2008 | Yu | 70/68 |
| 7,510,301 | B2 | 3/2009 | Dial | |
| 7,568,367 | B2 * | 8/2009 | Huang | 70/58 |
| 7,832,238 | B2 * | 11/2010 | Misner et al. | 70/21 |
| 7,870,764 | B2 | 1/2011 | Burmesch | |
| 7,946,141 | B2 | 5/2011 | Ng et al. | |
| 8,234,891 | B2 | 8/2012 | Dalton, Jr. et al. | |
| 8,353,184 | B2 | 1/2013 | Ling et al. | |
| 8,393,186 | B2 | 3/2013 | Schmidt et al. | |
| 8,453,481 | B2 | 6/2013 | Meekma | |
| 2006/0107708 | A1 * | 5/2006 | Yu | 70/21 |
| 2011/0239715 | A1 | 10/2011 | Weiershausen | |
| 2013/0118219 | A1 | 5/2013 | Basche | |

* cited by examiner

RESETTABLE COMBINATION LOCK MECHANISM

CROSS REFERENCE TO RELATED APPLICATIONS

The present application claims benefit of U.S. Provisional Patent Application No. 61/681,536 filed Aug. 9, 2012, entitled COMBINATION CABLE RESET MECHANISM which is incorporated herein by reference.

BACKGROUND

The disclosed embodiments generally pertain to locks, and particularly to combination cable reset mechanisms.

SUMMARY

A resettable lock assembly is provided having features that indicate when the lock is in reset mode or normal-use mode.

BRIEF DESCRIPTION OF THE ILLUSTRATIONS

Embodiments of the invention are illustrated in the following illustrations.

DETAILED DESCRIPTION

Figure 1:
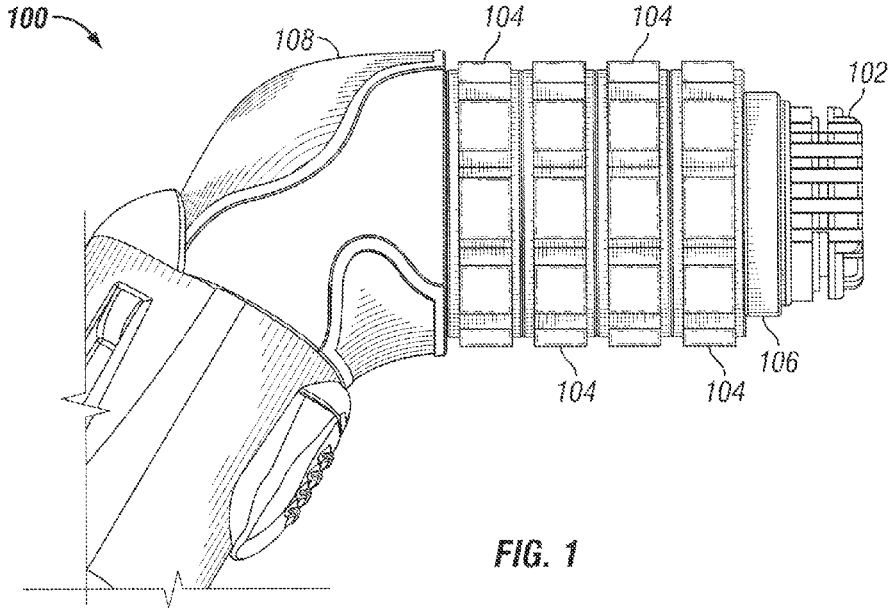
FIG. 1 illustrates a first embodiment of a lock assembly in a normal-use mode.
Figure 2:
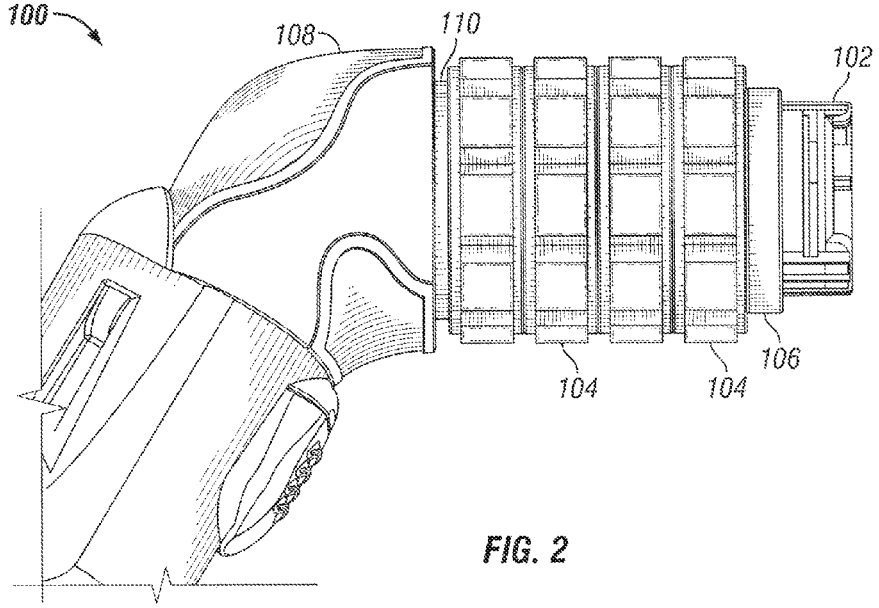
FIG. 2 depicts the lock assembly of FIG. 1 in a reset mode.

Referring now to FIG. 1, an embodiment of a lock assembly 100 is shown in normal-use mode with the reset knob 102 in a first position and the outer dials 104 and knob spacer 106 tight to the lock body 108. Referring to FIG. 2, the lock assembly 100 is shown in reset mode with the reset knob 102 in a second position and the outer dials 104 and knob spacer 106 moved away from the lock body 108 exposing a colored indicator 110 between the outer dials 104 and lock body 108.

Figure 3:
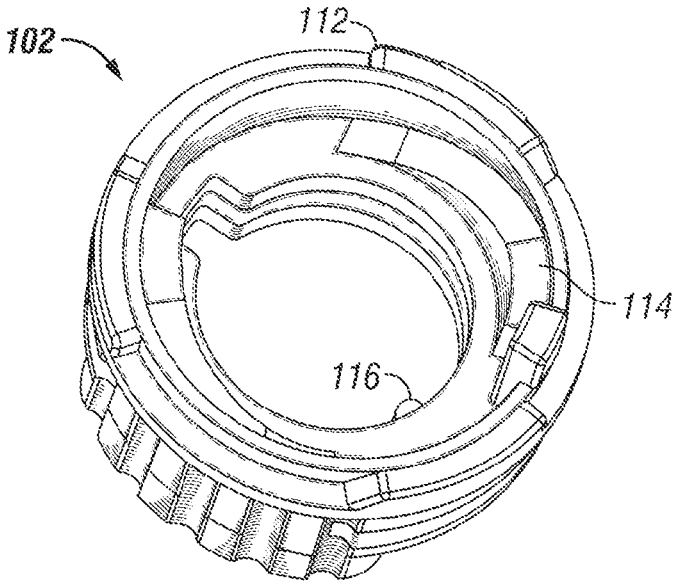
FIG. 3 shows a reset knob of the lock assembly of FIG. 1.
Figure 4:
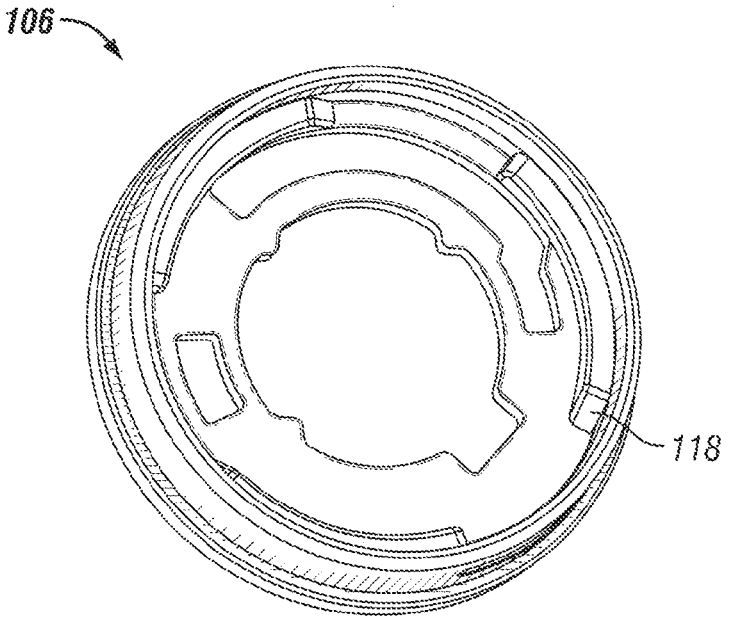
FIG. 4 shows a reset knob spacer as used in conjunction with the reset knob of FIG. 3.

Referring now to FIG. 3, the reset knob 102 is provided with outer ramps 112 and inner ramps 114. The reset knob is also provided with detent tabs 116 to provide feedback to the user. Referring now to FIG. 4, the knob spacer 106 is provided with knob ramps 118 that interact with the outer ramps 112 on the reset knob 102. This interaction is explained in greater detail herein.

Figure 5:
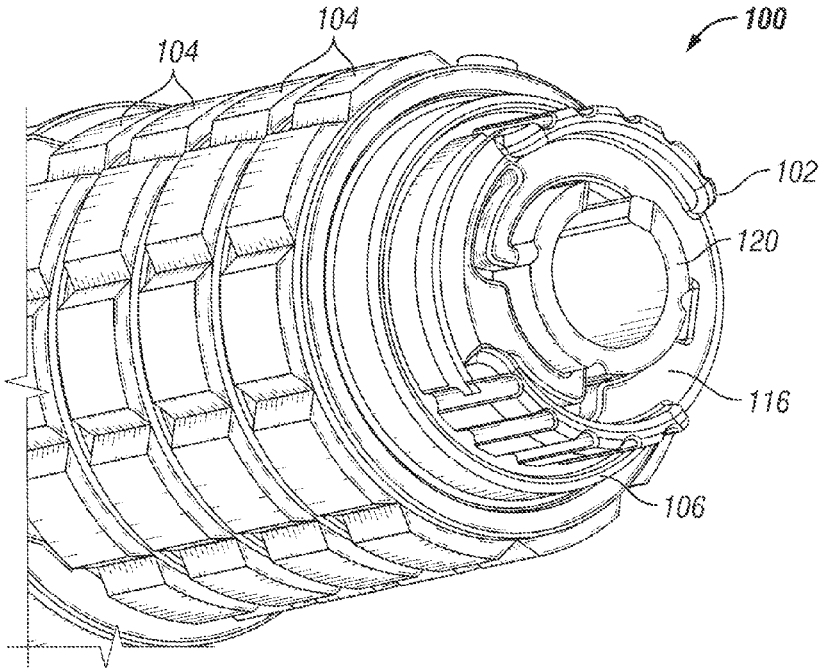
FIG. 5 depicts a detent system on a plastic reset knob.
Figure 6:
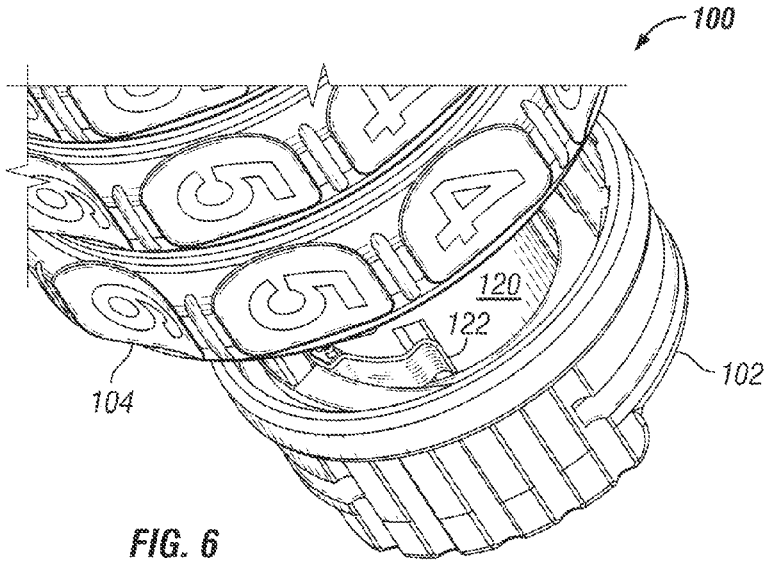
FIG. 6 depicts a detent system on a die cast reset knob.

Referring to FIGS. 5 and 6, detent systems are shown that provide feedback to the user to affirm whether the lock has been fully switched between normal-use and reset modes. In FIG. 5, an elastic tab 116 on a plastic reset knob 102 is provided to interact with a recess on an inner lock post 120.

Similarly in FIG. 6, a spring mechanism 122 on a die cast reset knob is provided to interact with recesses on an inner lock post 120.

Figure 7:
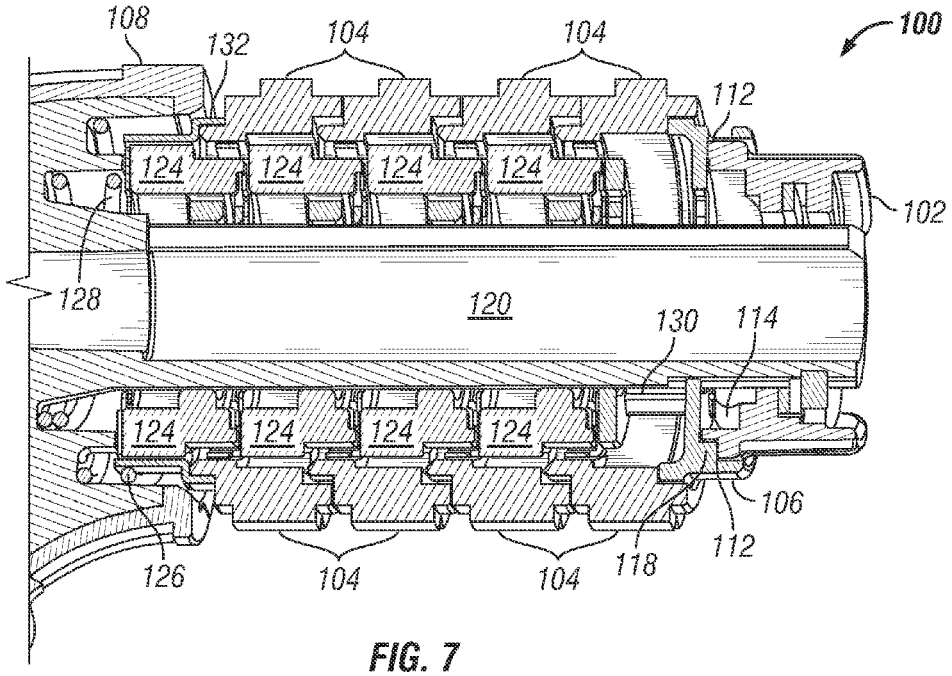
FIG. 7 is a cross-sectional view of a first embodiment of a lock assembly in reset mode.
Figure 8:
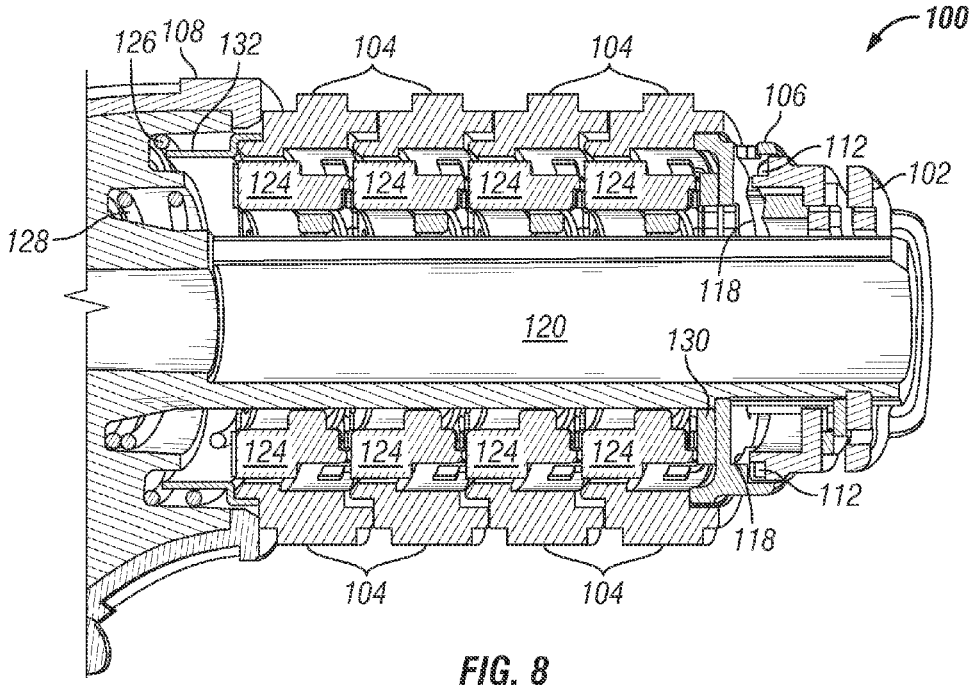
FIG. 8 is a cross-sectional view of the lock assembly in FIG. 7 in a normal-use mode.

Referring now to FIGS. 7 and 8, cross-sectional views of a lock assembly 100 are shown in reset and normal-use modes, respectively. The lock assembly 100 is provided with outer dials that are biased to the right of FIGS. 7 and 8 by an outer dial spring 126. The assembly 100 is further provided with inner dials 124 that are biased to the right of FIGS. 7 and 8 by an inner dial spring 128. The assembly 100 further comprises a reset slide 130 and a spring spacer 132. The spring spacer 132 is also provided with the colored indicator 110 shown in FIG. 1.

As shown in a reset mode in FIG. 7, the reset knob 102 on the lock assembly 100 is in a first rotational position. In this first position, the outer ramps 112 on the reset knob 102 are disengaged from the knob ramps 118 on the knob spacer 106. This allows the outer dials 104 to be biased by the outer dial spring 126 and translate to the right of the Figure exposing the colored indicator 110. With the reset knob in the same position, the inner ramps 114 on the reset knob 102 are engaged with the reset slide 130. This pushes the inner dials 124 against the bias of the inner dial spring 128 and translates the inner dials 124 to the left of the Figure. Accordingly, the outer dials 104 and inner dials 124 are disengaged allowing the user to reset the lock combination.

As shown in normal-use mode in FIG. 8, the reset knob 102 on the lock assembly 100 is in a second rotational position. In this second position, the outer ramps 112 on the reset knob 102 are engaged with the knob ramps 118 on the knob spacer 106. This allows the outer dials 104 to overcome the bias of the outer dial spring 126 and translate to the left of the Figure hiding the colored indicator 110. With the reset knob in the same position, the inner ramps 114 on the reset knob 102 are disengaged from the reset slide 130 which allows the inner dial spring 128 to bias and translate the inner dials 124 to the right of the Figure. Accordingly, the outer dials 104 and inner dials 124 are engaged allowing the user to use the lock.

As shown in FIGS. 7 and 8, the reset knob 102 moves from a first position to a second position by rotational movement.

Figure 9:
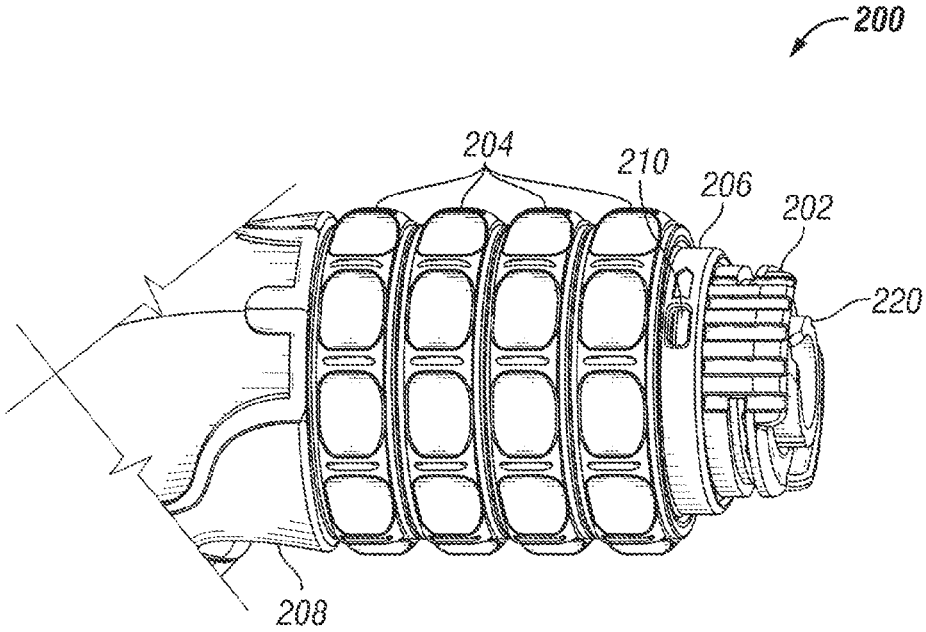
FIG. 9 illustrates a second embodiment of a lock assembly.
Figure 10:
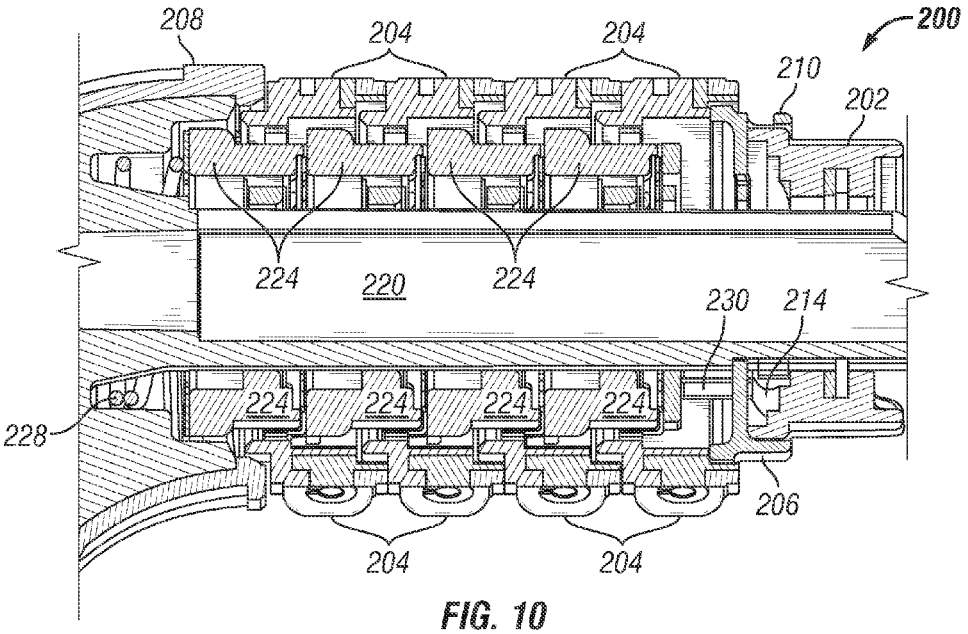
FIG. 10 is a cross-sectional view of a second embodiment of a lock assembly in a reset mode.
Figure 11:
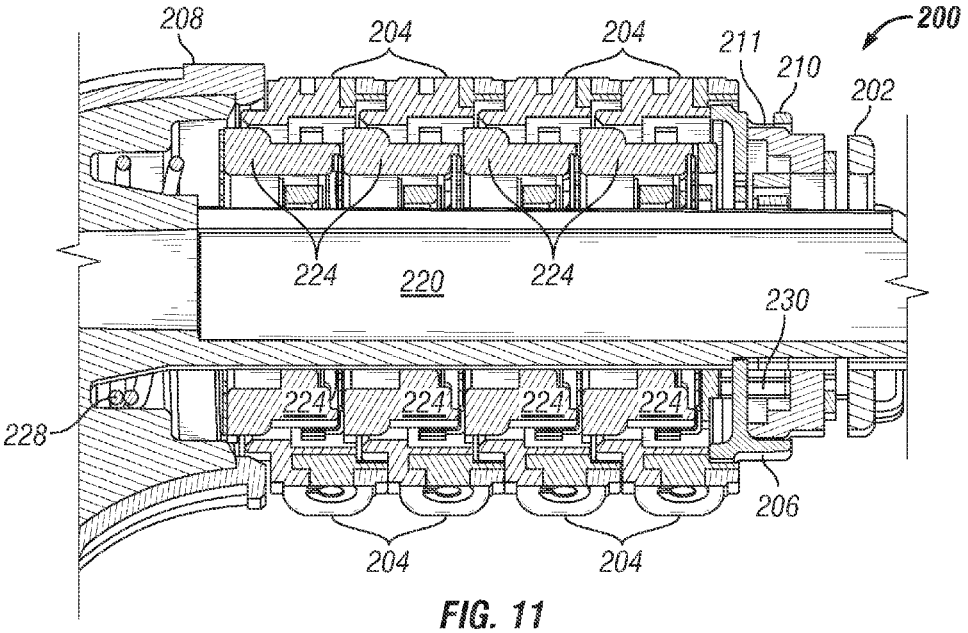
FIG. 11 is a cross-sectional view of the lock assembly in FIG. 10 in a normal-use mode.

Another embodiment of a lock assembly 200 is shown in FIGS. 9-11 in which the outer dials 204 are linearly fixed. Referring to FIG. 9, the outer dials 204 are tight to the lock body 208 regardless of whether the lock assembly 200 is in normal-use or reset mode. To indicate to a user which mode the lock assembly 200 is in, the knob spacer 206 is provided with an indicator window 210 to visually see a colored indicator 211 on the reset knob 202.

As shown in reset mode in FIG. 10, the reset knob 202 on the lock assembly 200 is in a first rotational position. In this first position, inner ramps 214 on the reset knob are engaged with a reset slide 230. This pushes the inner dials 224 against the bias of an inner dial spring 228 and translates the inner dials 224 to the left of the Figure. Accordingly, the outer dials 204 and inner dials 224 are disengaged allowing the user to reset the lock combination.

Referring now to FIG. 11, the lock assembly 200 is shown in normal-use mode. The reset knob 202 on the lock assembly 200 is in a second rotational position. In this second position, inner ramps 214 on the reset knob 202 are disengaged from the reset slide 230 which allows the inner dial spring 228 to bias and translate the inner dials 224 to the right of the Figure. Accordingly, the outer dials 204 and inner dials 224 are engaged allowing the user to use the lock.

As shown in FIGS. 10 and 11, the reset knob 202 moves from a first position to a second position by rotational movement. While the reset knob 202 is in the reset mode, a colored indicator 211 on the reset knob 202 shows through an indicator window 210 on the knob spacer 206.

The foregoing written description of structures and methods has been presented for purposes of illustration. Examples are used to disclose the invention, including the best mode, and also to enable any person skilled in the art to practice the invention, including making and using any devices or systems and performing any incorporated methods. These examples are not intended to be exhaustive or to limit the invention to the precise steps and/or forms disclosed, and many modifications and variations are possible in light of the above teaching. Features described herein may be combined in any combination. Steps of a method described herein may be performed in any sequence that is physically possible. The patentable scope of the invention is defined by the appended claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A lock assembly comprising:

an inner lock post having a first end and a second end;

a plurality of inner dials disposed about said inner lock post between said first end and said second end;

a plurality of outer dials disposed about said inner dials between said first end and said second end;

a reset knob rotationally secured to said inner lock post at said first end, wherein said reset knob has a first rotational position and a second rotational position;

a lock body disposed at said second end;

a knob spacer slidably mounted to said inner lock post between said inner and outer dials, and said reset knob; and a spring biased between said lock body and said inner dials;

wherein when said reset knob is in said first rotational position, the lock assembly is in a reset mode and a visual indicator is visible to a user; and wherein when said reset knob is in said second rotational position, the lock assembly is in a normal-use mode and the visual indicator is not visable.

* * * * *